US005156617A

United States Patent [19]

Reid

[11] Patent Number: 5,156,617

[45] Date of Patent: Oct. 20, 1992

[54] PACIFIER COVER

[76] Inventor: Toi L. Reid, 19936 Lahser, Detroit, Mich. 48219

[21] Appl. No.: 658,682

[22] Filed: Feb. 21, 1991

[51] Int. Cl.[5] ..... A61J 17/00

[52] U.S. Cl. ..... 606/234; 606/236; D24/194; D24/195

[58] Field of Search ..... 606/234, 235, 236; D24/194-199

[56] References Cited

U.S. PATENT DOCUMENTS

| | | | |
|---|---|---|---|
| D. 243,366 | 2/1977 | Lybe et al. | 606/234 |
| D. 276,939 | 12/1984 | Pascoe | D24/46 |
| 2,824,561 | 2/1958 | Mueller . | |
| 2,860,639 | 11/1958 | Hoover . | |
| 3,363,630 | 1/1968 | Hines | 606/234 |
| 3,392,729 | 7/1968 | Lenoir . | |
| 4,329,996 | 5/1982 | Copeland . | |
| 4,417,613 | 11/1983 | Ryan et al. . | |
| 4,493,324 | 1/1985 | Johnston . | |
| 4,852,569 | 8/1989 | Sanders | 606/234 |
| 4,946,054 | 9/1990 | Maniero et al. | 215/11.6 |
| 4,990,157 | 2/1991 | Roberts et al. | 606/234 |

*Primary Examiner*—Stephen C. Pellegrino
*Assistant Examiner*—Glenn K. Dawson
*Attorney, Agent, or Firm*—Brooks & Kushman

[57] ABSTRACT

A pacifier cover (10) for keeping an infant's pacifier clean is disclosed which includes a base (16), a cover portion (18) hingeably attached to the base (16), and snaps (20, 26) for removably securing a pacifier (14) to the base (16). The cover portion (18) is moveable between a closed position in which the cover portion encloses the pacifier (14) and prevents contact with the surrounding environment, and an open position in which the pacifier (14) may be attached to or removed from the base (16).

9 Claims, 2 Drawing Sheets

PACIFIER COVER

TECHNICAL FIELD

This invention relates to covers for infant pacifiers.

BACKGROUND ART

In an effort to prevent an infant's pacifier from being dropped and lost when not in the infant's mouth, designs have been proposed in which a ribbon connects the pacifier to a plastic pendant which is, in turn, attached to the infant's clothing. Because the pacifier dangles freely when not in use, however, the pacifier comes into contact with lint and dirt in the surrounding environment. Before the pacifier can be hygienically reused, it must first be cleaned.

Various United States patents have addressed this problem. U.S. Pat. Nos. 2,860,639 to Hoover, 4,417,613 to Ryan et al, 4,493,324 to Johnston, and 4,946,054 to Maniero et al., disclose a pacifier cover or shield which is snapped in place over the pacifier. A drawback to this design is that the cover is a separate element which is not attached to the infant when the pacifier is in use. An alternative design is disclosed in U.S. Pat. No. 4,329,996 to Copeland, in which a detachable cap might be tied to the infant with a ribbon. The cap of this design, however, must be unscrewed from the pacifier, reversed, and screwed in again to alternately expose or cover the pacifier.

SUMMARY OF THE INVENTION

It would be desirable to have a pacifier cover that can be attached to an infant's clothing and which provides an easily accessible covering for a connected pacifier. Therefore, the pacifier cover of the present invention comprises a base, a cover portion, and a snap. The base has a pacifier storage side and an infant attachment side. The cover portion is hingeably attached to the base, and is moveable between a closed position in which the cover portion is substantially in closed relation with the base, and an open position in which the storage side of the base is exposed to view. The cover portion is configured to enclose the pacifier when the cover portion is in its closed position. The snap is located on the storage side of the base and is adapted to mate with a second snap on the pacifier such that the cover portion in its closed position encloses the pacifier and prevents contact with the surrounding environment.

Accordingly, it is an object of the invention to provide an improved pacifier cover that can be attached to an infant's clothing and which provides an easily accessible covering for a connected pacifier.

Another object of the invention is to provide a pacifier cover in which a cover portion is moveable between a closed position in which the cover portion is substantially in closed relation with a base and an open position in which a storage side of the base is exposed to view.

Another object of the invention is to provide a pacifier cover adapted to be attached to an infant for keeping a pacifier clean, the cover comprising a base having a pacifier storage side and an infant attachment side, a cover portion hingeably attached to the base, the cover portion movable between a closed position in which the cover portion is substantially enclosed relation with the base, and an open position in which the storage side of the base is exposed to view, the cover portion being configured to enclose the pacifier when in its closed position, and means on the storage side of the base for removably securing the pacifier thereto such that the cover portion in its closed position is adapted to enclose the pacifier and prevent contact with the surrounding environment.

Another object of the invention is to provide a pacifier cover as described above and having means for connecting the pacifier to the pacifier cover to prevent the pacifier from becoming lost.

These and other objects, features, and advantages of the present invention will be more apparent from the following description and drawings.

BEST MODE FOR CARRYING OUT THE INVENTION

Figure 1:
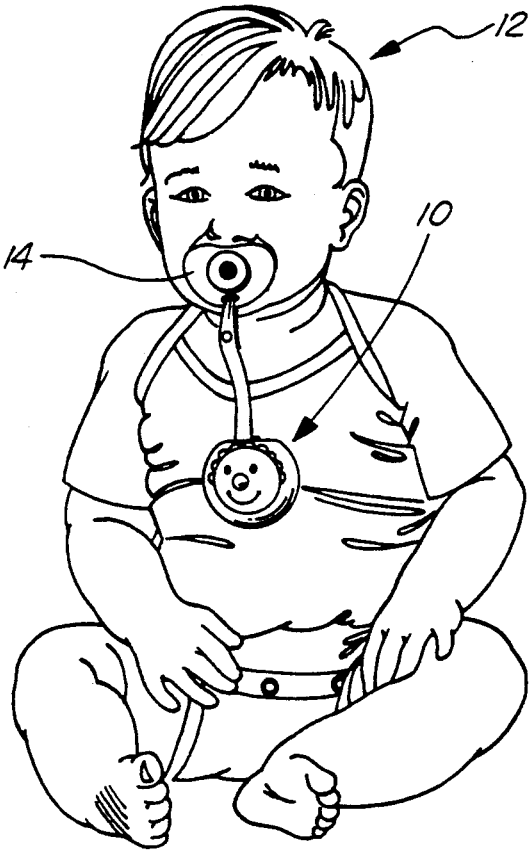
FIG. 1 is a perspective view of one embodiment of a pacifier cover according to my invention attached to an infant.
Figure 2:
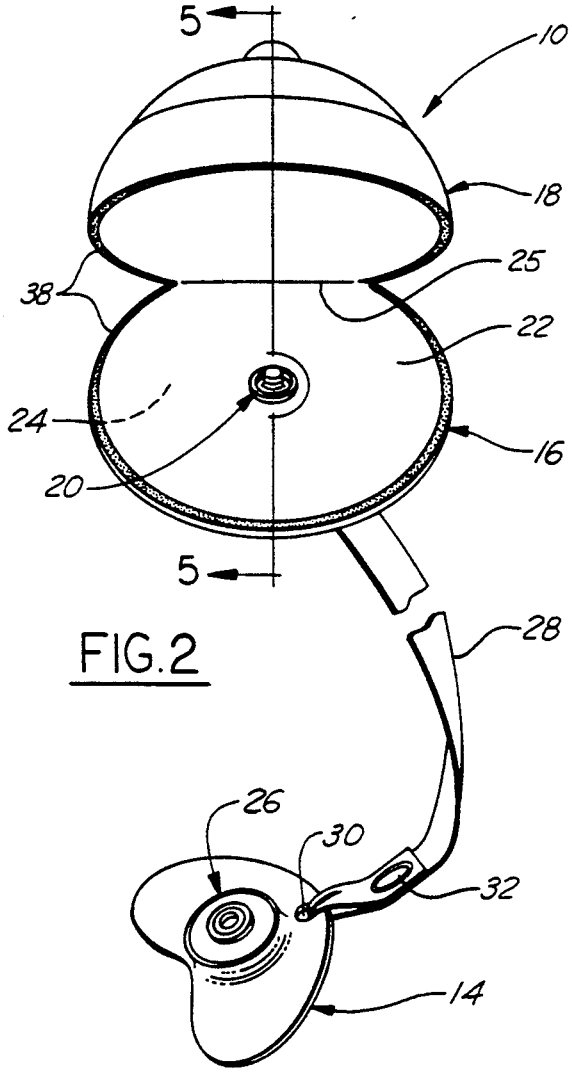
FIG. 2 is a perspective view of the pacifier cover with a cover portion in an open position and with a pacifier unattached to a base.

With reference to the drawings, the preferred embodiments of the present invention will be described. Referring to FIG. 1, there is shown a pacifier cover 10 attached to an infant 12. The pacifier cover 10 is intended to be used in combination with a pacifier 14 to keep the pacifier 14 clean. As shown in FIG. 2, the pacifier cover 10 comprises a base 16, a cover portion 18, and a first snap 20. The base 16 is substantially flat and is made of any relatively rigid material such as hard plastic, and has a pacifier storage side 22 and an infant attachment side 24. The cover portion 18 is hingeably attached to the base 16, either integrally or by a separate hinge 25. It should be understood, however, that the cover portion 18 and base 16 can be hingeably attached to each other by alternative methods such as sewing or gluing. The cover portion 18 is movable between a closed position in which the cover portion 18 is substantially in closed relation with the base 16, and an open position shown in FIG. 2 in which the storage side 22 of the base 16 is exposed to view. The cover portion 18 is made of either a flexible plastic or a plastic backed fabric so that it flattens easily if the infant lies on it, and is configured to enclose the pacifier 14 when the cover portion 18 is in its closed position.

The first snap 20 is located on the storage side 22 of the base 16, and is adapted to mate with a second snap 26 on the pacifier 14. When the snaps 20 and 26 engage each other the pacifier 14 is removably secured to the storage side 22 of the base 16. Alternative means for removably securing the pacifier 14 to the storage side 22 of the base 16 such as magnets or strips of hook and loop type fasteners (for example Velcro) are equally viable. When so secured, the cover portion 18 in its closed position encloses the pacifier 14 and prevents contact with the surrounding environment.

Figure 3:
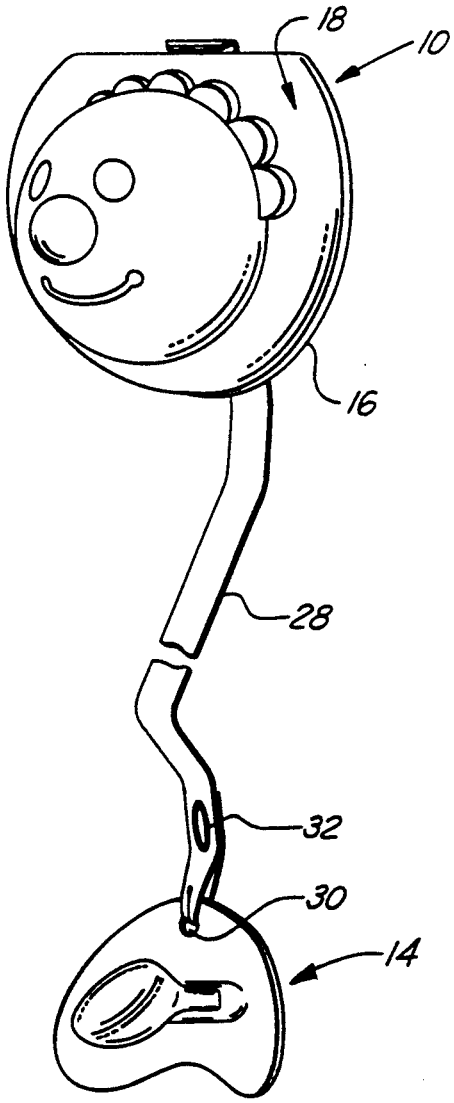
FIG. 3 is a perspective view of the pacifier cover with the cover portion in a closed position and with the pacifier unattached to the base.

FIG. 3 shows cover portion 18 of the pacifier cover 10 in the closed position and with the pacifier 14 unattached to the base 16. A ribbon 28 connects the pacifier 14 to the pacifier cover 10 to prevent the pacifier 14 from being lost if it is not in the infant's mouth or secured on the storage side 22 of the base 16. The ribbon 28 is attached to the pacifier 14 by inserting one end of the ribbon through a slot 30 in the pacifier 14, and resecuring the ribbon to itself by snap 32. This allows the pacifier 14 to be removed from the ribbon 28 when necessary, for example if the pacifier needs to be sterilized. Preferably, the ribbon 28 is short enough that the pacifier 14 cannot fall out of the infant's reach or drag on the ground. However, the ribbon 28 must be long enough to allow the pacifier 14 to be inserted comfortably into the infant's mouth while the pacifier cover 10 is attached to the infant.

Figure 4:
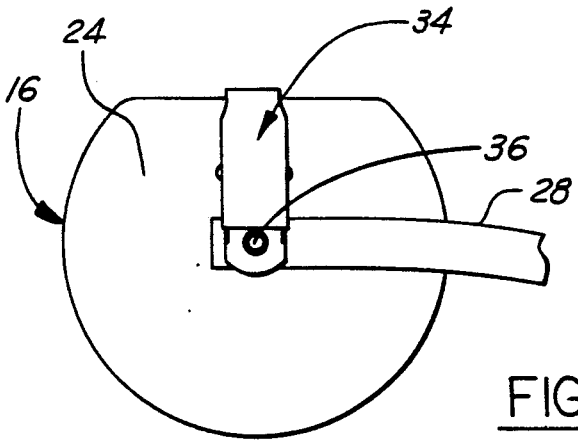
FIG. 4 is a plan view of the infant attachment side of the base of the pacifier cover.

FIG. 4 shows the infant attachment side 24 of the base 16. A pinch clip 34 provides the means for removably attaching the pacifier cover 10 to the infant. The pinch clip 34 is pivotably mounted to the infant attachment side 24 of the base 16 by a rivet 36. This allows the base 16 to be rotated to an upright position, regardless of the angle at which the pinch clip 34 is attached to the infant's clothing. The rivet 36 also functions to secure the ribbon 28 to the base 16.

Figure 5:
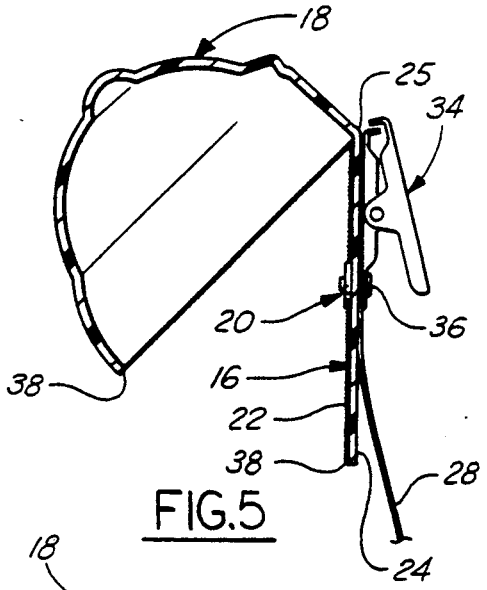
FIG. 5 is a cross-sectional view of the pacifier cover with the cover portion in the open position, the cross-section taken along lines 5—5 of FIG. 2.
Figure 6:
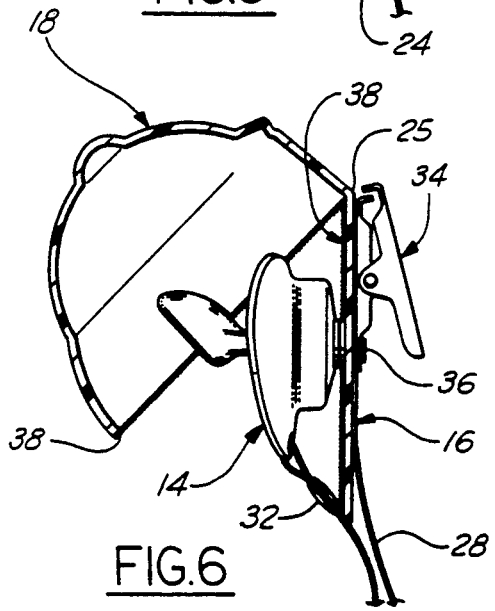
FIG. 6 is a cross-sectional view of the pacifier cover similar to FIG. 5 and showing the pacifier secured to the pacifier storage side of the base.

FIGS. 5 shows a cross-sectional view of the pacifier cover 10 with the cover portion 18 in the open position. In FIG. 6, pacifier 14 is shown secured to the pacifier storage side 22 of the base 16. When the pacifier 14 is secured to the base 16, the cover portion 18 in its closed position is adapted to enclose the pacifier 14 from contact with the surrounding environment.

Figure 7:
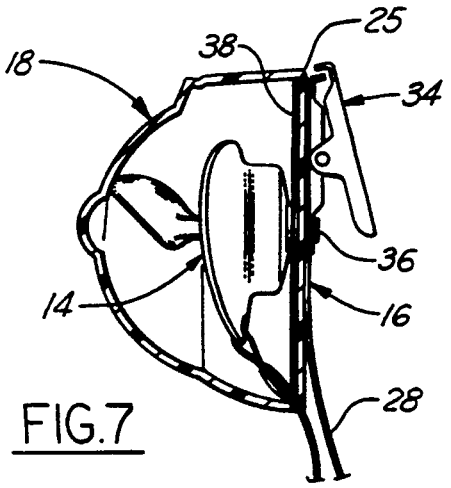
FIG. 7 is a cross-sectional view of the cover portion in the closed position and showing the pacifier secured to the pacifier storage side of the base.

FIG. 7 shows a cross-sectional view of the pacifier cover 10 with the cover portion 18 in the closed position and enclosing the pacifier 14. In the closed position, fastening means, such as strips of hook and loop type fasteners 38 positioned around the perimeter of the cover portion 18 and the storage side 22 of the base 16 secures the cover portion 18 to the base 16. Even when the cover portion 18 is in the closed position, the ribbon 28 extends between the cover portion 18 and the base 16 without hindering securement of the cover portion 18 to the base 16.

The pacifier cover 10 thus provides an easily-accessible container which is attached to the infant for the unused pacifier 14. The infant's parent thus avoids any need to rummage through a diaper bag to find the pacifier, or to store the pacifier in a clean place when not in use. When the infant desires the pacifier, the cover portion 18 is lifted, and the clean pacifier 14 detached from the base 16 and given to the infant. When the infant no longer desires the pacifier 14, the cover portion 18 is lifted, the pacifier 14 is snapped back onto the base 16, and the cover portion 18 closed. The pacifier 14 is then out of the way, but still within reach.

It should be understood that while the forms of the invention herein shown and described constitute preferred embodiments of the invention, they are not intended to illustrate all possible forms thereof. It also should be understood that the words used are words of description rather than limitation, and various changes may be made without departing from the spirit and scope of the invention disclosed.

What is claimed is:

1. A pacifier cover adapted to be attached to an infant for keeping a pacifier clean, the cover comprising:

a base having a pacifier storage side and an infant attachment side;

a cover portion hingeably attached to the base, the cover portion movable between a closed position in which the cover portion is substantially in closed relation with the base, and an open position in which the storage side of the base is exposed to view, the cover portion being configured to enclose the pacifier when in its closed position;

means on the infant attachment side of the base for removably attaching the pacifier cover to the infant; and means on the storage side of the base for removably securing the pacifier thereto such that the cover portion in its closed position encloses the pacifier and prevents contact with the surrounding environment.

2. The pacifier cover of claim 1 further comprising means for connecting the pacifier to the pacifier cover to prevent the pacifier from being lost when it is not secured on the storage side of the base.

3. The pacifier cover of claim 2 wherein the means for connecting the pacifier to the pacifier cover to prevent the pacifier from being lost comprises a ribbon.

4. The pacifier cover of claim 2 wherein the means on the storage side of the base for removably securing the pacifier, thereto comprises a first snap on the storage side of the base adapted to mate with a second snap on the pacifier.

5. The pacifier cover of claim 1 wherein the means for removably attaching the pacifier cover to the infant comprises a pinch clip attached to the infant attachment side of the base.

6. The pacifier cover of claim 1 further comprising means for securing the cover portion in its closed position to the base.

7. The pacifier cover of claim 6 wherein the means for securing the cover portion in its closed position to the base comprises hook and loop type fastener means.

8. A pacifier cover and pacifier assembly adapted to be attached to an infant for keeping a pacifier clean, the assembly comprising:

a pacifier;

a base having a pacifier storage side and an infant attachment side;

a cover portion hingeably attached to the base, the cover portion moveable between a closed position in which the cover portion is substantially in closed relation with the base, and an open position in which the storage side of the base is exposed to view, the cover portion being configured to enclose the pacifier when in its closed position;

a first snap on the storage side of the base;

a second snap on the pacifier adapted to mate with the first snap to allow the pacifier to be removably secured to the storage side of the base such that the cover portion in its closed position is adapted to enclose the pacifier and prevent contact with the surrounding environment;

a ribbon having a first end connected to the pacifier and a second end connected to the pacifier cover to prevent the pacifier from being lost;

a pinch clip attached to the infant attachment side of the base for removably attaching the pacifier cover to the infant; and means for securing the cover portion in its closed position to the base.

9. A pacifier cover adapted to be attached to an infant for keeping a pacifier clean, the cover comprising:

a base having a pacifier storage side and an infant attachment side;

a cover portion hingeably attached to the base, the cover portion movable between a closed position in which the cover portion is substantially in closed relation with the base, and an open position in which the storage side of the base is exposed to view, the cover portion being configured to enclose the pacifier when in its closed position;

a pinch clip attached to the infant attachment side of the base for removably attaching the pacifier cover to the infant; and means on the storage side of the base for removably securing the pacifier thereto such that the cover portion in its closed position encloses the pacifier and prevents contact with the surrounding environment.

* * * * *